United States Patent [19]

Curtis et al.

[11] Patent Number: 4,715,310

[45] Date of Patent: Dec. 29, 1987

[54] MARINE SHOCK ABSORBING APPARATUS WITH STABILIZERS

[75] Inventors: Walter B. Curtis, Thibadaux; Gregory L. Davis; Mark C. Klimowicz, both of Morgan City, all of La.

[73] Assignee: Texaco Inc., White Plains

[21] Appl. No.: 756,543

[22] Filed: Jul. 19, 1985

[51] Int. Cl.[4] ..... B63B 59/02

[52] U.S. Cl. ..... 114/220; 405/213; 267/140

[58] Field of Search ..... 114/219, 220; 405/211, 405/212, 213; 267/139, 140

[56] References Cited

U.S. PATENT DOCUMENTS

| | | | |
|---|---|---|---|
| 4,084,801 | 4/1978 | Landers et al. | 114/219 X |
| 4,273,473 | 6/1981 | Thomerson et al. | 114/219 X |
| 4,293,241 | 10/1981 | Helveston et al. | 405/213 |
| 4,363,474 | 12/1982 | Leblanc et al. | 267/140 |

*Primary Examiner*—Sherman D. Basinger
*Assistant Examiner*—Paul E. Salmon

[57] ABSTRACT

In a shock absorbing system for an offshore platform one or more shock absorbing cells receive the initial impact of a floating vessel. When such a cell becomes disfunctional or damaged, it is temporarily immobilized by positioning a stabilizer thereon. The latter is provisionally installed on the shock cell to substantially avoid relative movement between coacting parts.

6 Claims, 4 Drawing Figures

3
33
36
31
3
28
13
29
26
23
22
24
21
27

MARINE SHOCK ABSORBING APPARATUS WITH STABILIZERS

BACKGROUND OF THE INVENTION

Any structure that is built adjacent to a body of water or surrounded by a body of water, is normally made accessible to boats, barges, and other marine vessels. However, when attempting to tie up a vessel to the stationary structure, care must be exercised particularly in the instance of heavier vessels to avoid damaging either the structure or the vessel.

For example, a vessel attempting to tie up to, or become docked to a structure in an open body of water, is subjected to prevailing atmospheric conditions. The latter can include both wind and tide forces which could affect the operation of the vessel.

Most notably, in a docking operation, the vessel's speed is substantially reduced to minimize its impact when and if it contacts the offshore structure. Usually, however, the vessel will make some contact with the fixed structure, the degree of its striking force being a function of the above noted natural conditions.

In view of the anticipated docking difficulties, virtually all offshore structures are furnished with a suitable mooring apparatus. To be effective, such an apparatus must be capable of absorbing the initial shock of a vessel coming into, or being pulled into contact with the structure. Such shock absorbing devices are of particular relevance in tidal waters where the direction of flow, and the velocity of the water about the stationary structure can be drastic.

In the instance of most offshore steel jacket type structures where large tankers or similar supply vessels will frequently dock, the structure is always provided with a shock absorbing apparatus. The latter normally embodies means whereby, should the floating vessel accidentally come into sharp or uncontrollable contact with the structure, the resulting shock will to a large part be absorbed or dampened rather than being transferred to the structure's support legs.

Such mooring facilities are normally at least partially submerged at the structure. When properly located, they balance the resisting force to overcome the vessel's momentum. Secondly the variation in the height of the tide may be such as to warrant that the shock absorbing device be relatively high to cover the types of vessels which are normally being brought in contact with it.

Among the many types of shock absorbing means used on both vessels and on platforms, there are both mechanical and non-mechanical types. In the instance of the simpler types, interconnected and operable parts are avoided due to the corrosive atmosphere and the periodic submersion in the water to which the mooring device will be subjected. In the instance of steel offshore structures, the effect of corrosive deterioration on the shock absorbing device will be noticeably pronounced.

On some of these devices the use of a compressible and reformable material to absorb a vessel's initial shock is widespread. Such materials include rubber, various plastics, and inflatable bodies.

Toward overcoming or at least alleviating the problem of the harsh environment to which the shock absorbing devices are subjected, the present invention provides in an offshore platform, mooring means capable of receiving and absorbing the impact of a vessel which is moved against it. The mooring means includes at least one shock absorbing member which is capable of deflecting in response to the initial force of the moving vessel.

Toward retaining a degree of viability in the shock absorbing system, even when it has become damaged or experiences excessive wear, a stabilizing means is provided which is provisionally incorporated into the shock absorbing cell. The stabilizer serves the purpose of minimizing displacing movement to which the latter will be subjected.

The stabilizer includes primarily a collar-like device which is adapted for detachable connection to the shock absorbing cell which is incorporated into the shock absorbing apparatus. The stabilizer in achieving its purpose, is removably connected to the shock absorbing cell. This is achieved in a manner to limit or minimize movement between the parts of said device which would otherwise be displaced in response to the contact between a floating vessel and the marine structure.

It is therefore an object of the invention to provide in an offshore marine platform of the type contemplated, means whereby a ship docking member might be protected from excessive wear under extenuating operating conditions.

A further object is to provide a shock absorbing member of the type contemplated to which a stabilizer is adapted for connection to preclude major damage after a shock absorbing cell has become substantially inoperative.

A still further object of the invention is to provide a ship docking system of the type contemplated in which the shock absorbing mooring arrangement can be stabilized or neutralized pending necessary repairs to the unit as the result of extreme displacing forces.

Figure 1:
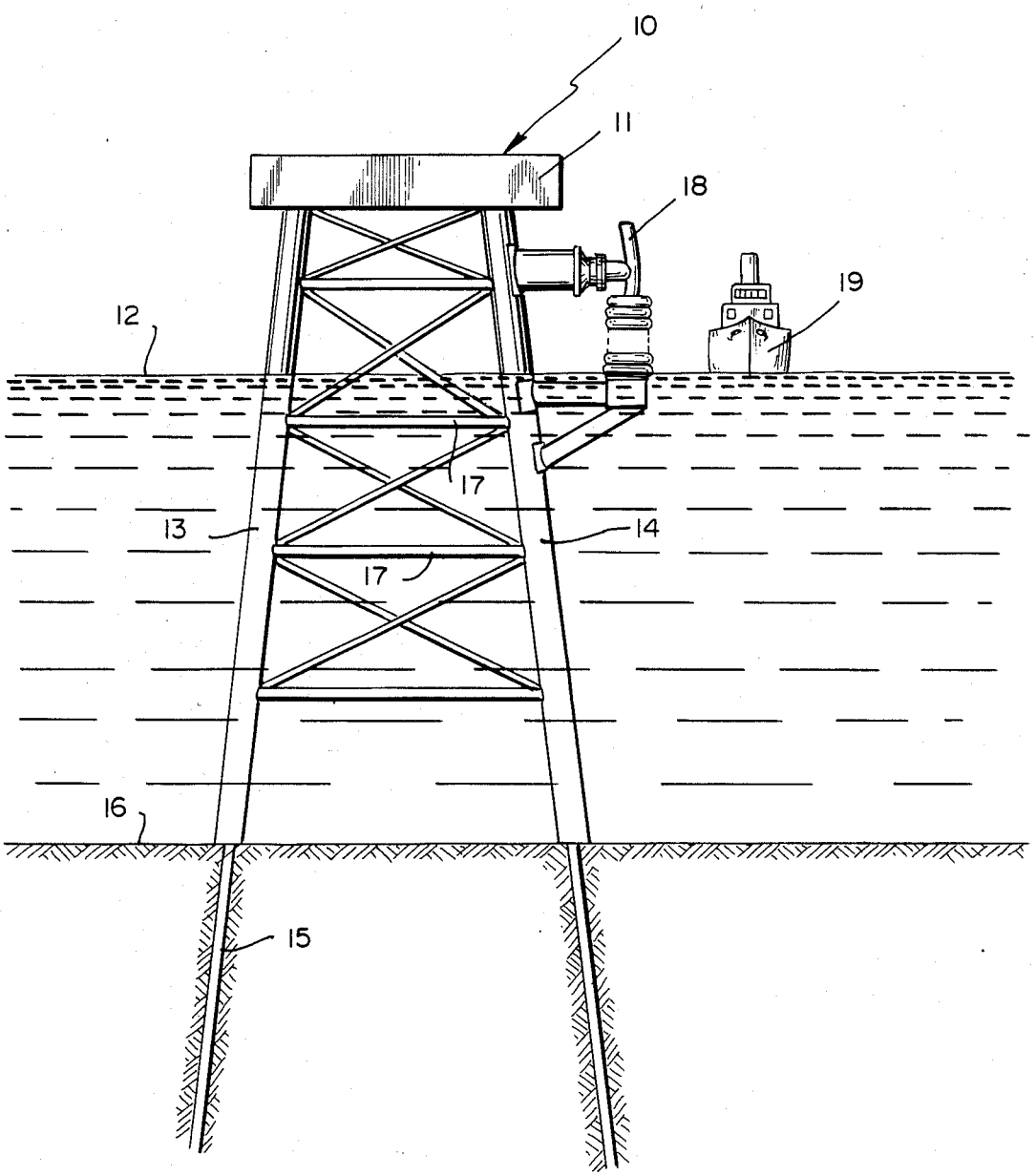
FIG. 1 is an environmental view of an offshore or marine structure adapted for receiving a floating vessel.
Figure 2:
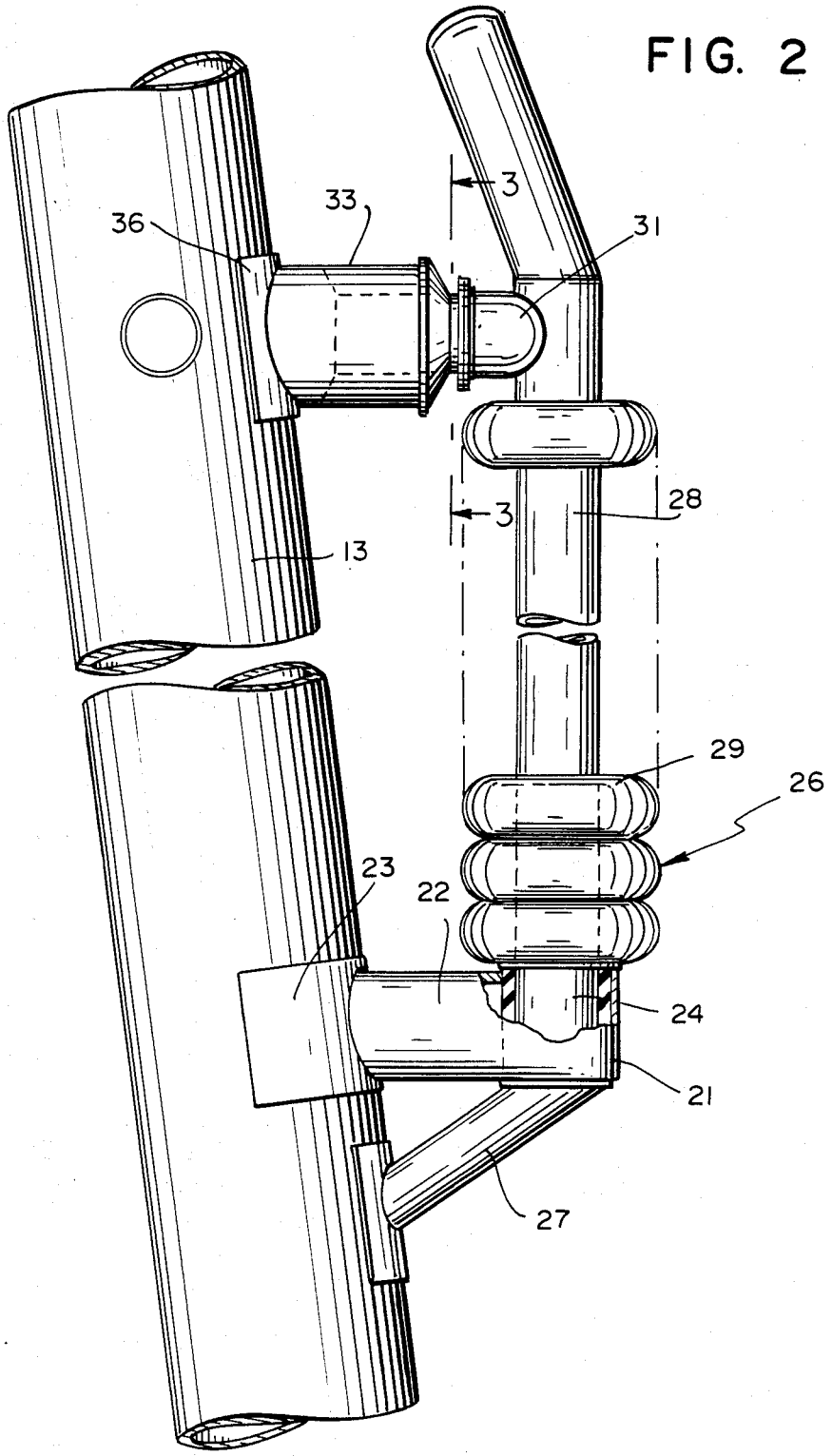
FIG. 2 is an enlarged segmentary view of the structure's shock absorbing apparatus.

Referring to the Figures, an offshore structure 10 of the type contemplated is shown positioned in a body of water. The structure comprises primarily a working deck 11 which is normally positioned 50 or 60 feet above the water level 12 to be placed out of contact with the latter. Deck 11 is supported by a plurality of substantially vertical support legs 13 and 14 which extend downwardly from the deck and into the sea floor 16 and generally define a jacket.

To position the jacket the latter, while not shown in detail, is provided with piles 15 which can be driven from the water's surface into the floor 16.

As a matter of practicality, each leg of the multi-leg jacket is piled to the floor. Such procedure virtually precludes damage to the structure due to the effects of extreme weather conditions or to being sharply contacted by a heavy floating vessel 17 such as a tanker or the like.

The respective support legs 13 and 14 which are connected by intermediate cross members 17 are so constructed as to form the jacket which is capable of supporting the deck and ancillary operating equipment.

The jacket legs as shown can be generally battered rather than being vertical. The legs, however, are normally sufficiently close such that a boat landing or shock absorbing system 18 can be mounted to two or more of the legs.

In the present arrangement and referring to the Figures, boat docking system 18 is positioned on one side of the jacket and includes primarily a base or foundation member 21 which depends from support leg 13 at a point below the water's surface 12. Foundation member 21 includes primarily a tubular 22 which is attached to a transition piece 23. The latter can be bolted or welded to the surface of leg 13. Tubular 22 extends outwardly, generally in a horizontal direction, and terminates at a terminal piece 24 from which a contact or king post 26 depends vertically upward.

The lower part of the foundation or tubular 22 is provided with a support arm 27 which connects to the underside of terminal piece 24 and is engaged at its other end to leg 13.

The upright shock absorbing post 26 includes basically a cushioned column. The latter in simplest terms comprises an elongated tubular column 28 which is operably positioned at its lower end in terminal piece 24. It extends upwardly to a point above the water's surface 12. The substantially vertically standing king post 26 is provided with a plurality of resilient members 29 such as inflatable tubulars or even rubber tires, which are initially positioned about the center post prior to the latter being fastened into place.

The upper end of king post 26 terminates above the water's surface 12 and is provided with a horizontal flanged connector 31.

Toward anchoring the upper end of king post 26, a shock absorbing unit or cell 33 is positioned above the foundation member 21.

Shock absorbing unit 33 includes primarily a cylindrical casing 34 which, at its fixed end, includes a curved mounting plate 36 having a curvature which permits it to be fixed to the outer surface of the leg 13 either by welding, bolting, or other suitable means.

Casing 34 is preferably cylindrical in configuration and extends in a substantially horizontal direction away from the support leg 13.

A pipe member 37 is disposed internally of casing 34 and extends substantially coaxially thereof defining an annular passage 38 therebetween. Said annular passage 38 is substantially filled by an annular collar 39 formed of a suitable compressible and resilient material. The latter can be adhered along its outer and inner walls to an adjacent wall of casing 34 as well as the center pipe 37, and thereby serve as a shock absorbing element.

In the present arrangement, the annular collar 39 can be formed of a suitable plastic material which is connected by an adhesive applied between the inner wall of the casing 34 and the shock absorbing element. Similarly, the outer wall of the pipe member 37 is provided with an adhesive which is capable of retaining the annular collar 39 in place while permitting it to deform.

Functionally, and as shown, when a horizontal force is applied to the upright king post 26, said member will be pivotally displaced around its fixed lower end. The degree of angular displacement will be contingent on the inbuilt movement of pipe member 37. However, the constrained relationship between casing 34, pipe member 37 and the shock absorbing collar 39 is such that the pipe will be urged to an outward or extended position with respect to the casing.

The remote end of the pipe member 37 is provided with a flange 41 which is connected through a series of bolts 42 to a corresponding flange 43 which depends from connecting piece 31. As seen, when the boat bumper is at rest and not subjected to a horizontal force by a vessel 19, the pipe member 37 will assume a generally outward position within casing 34. At such a time, the pipe is urged by collar 39 to its extended position.

In contrast, when the mooring column or king post 26 has been displaced inwardly toward leg 13, resilient collar 39 will be compressed both inwardly and laterally to deform under the extreme conditions as applied by moving vessel 19.

When the shock absorbing system has been subjected to repeated extreme conditions, the deforming capabilities of resilient annular collar 39 will deteriorate to the point where it will not properly support the king post. Further, there could occur a physical separation of the resilient collar 39 from casing 34 and/or pipe 37. More notably, the structure of shock cell 33 is such that when functioning properly central pipe 37 is not only depressible concentrically with casing 39, said pipe is also deformable so as to absorb lateral movement of the king post. This universality of movement tends to separate the resilient collar from its fastening walls.

In any event, when subjected to such extreme movement over a period of time, the shock cell 33 will progressively lose its effectiveness, as shock absorbing collar 39 becomes more detached from one or both of its connecting members. In such an instance, should the condition persist, or be ignored, eventually king post 26 will suffer severe damage and possibly require replacement.

Replacement of such a unit constitutes a major operation since it places the entire boat bumper apparatus 18 out of operation for a period of time. It may also require not only the replacement of king post 26, but also the remounting of a new foundation piece 21, and further possibly repairing of the upper shock absorbing member 33.

In summary, if the above noted deleterious conditions to shock cell 33 are not remedied rather quickly, ultimate damage can be extrapolated to the point where the entire shock absorbing system 18 might have to be replaced. However, to maintain the boat bumper system in a less than effective, although operating condition, the shock cell 33 is provided with a provisional stabilizer 46.

The function of shock cell stabilizer 46 is to temporarily minimize the movement between the cooperating casing members 33 and pipe 37 of the shock cell, in spite of a horizontal force which is applied against the king post 26 by a floating vessel 19.

In achieving this function, shock cell stabilizer 46 comprises a collar 47 capable of being provisionally placed around the center pipe 37 of the shock cell 33. Said collar 47 is preferably split although hinged into two segments. This structure permits its being applied as noted, without disrupting operation of the overall boat bumper system 18.

Figure 3:
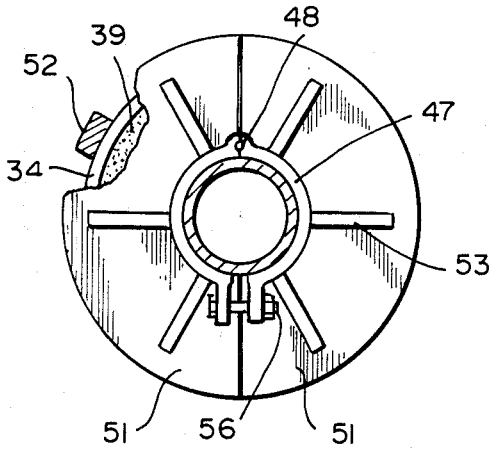
FIG. 3 is an enlarged segmentary view of a section shown in FIG. 2.
Figure 4:
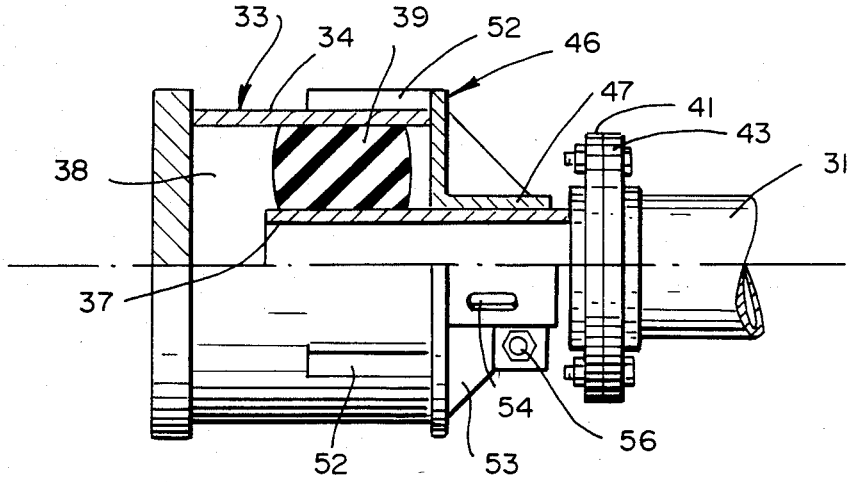
FIG. 4 is an enlarged segmentary view of a section of FIG. 2.

Referring to FIGS. 3 and 4, stabilizer 46 is comprised primarily of a circular collar 47 formed in two parts. When in closed condition, the collar forms an inside diameter substantially corresponding to the diameter of the shock cell pipe 37. Collar 47 is provided at one side with a hinge connection 48 having a hinge pin and at the other end with a tightenable locking arrangement. Alternatively, both ends of the collar can be provided with a bolting or pinning means whereby the collar can be applied to the central pipe 37 and there fixedly tightened in place.

The lower end of each collar segment 47 is provided with one or more radially extending arms 51. The latter extend outwardly from the collar lower edge a sufficient distance to contact and overlap the facing edge of casing 34. In one embodiment of collar 47, the radial extending arms 51 comprise a semicircular plate or skirt which is welded to the lower edge of the collar 47, the skirt outer rim extending outward past the facing edge of casing 34.

The need for this application of stabilizer 46 on a shock absorber cell 33 will be dictated as herein noted by misfunctioning of the cell. For example, when resilient collar 39 becomes inoperable, pipe 37 will be unable to move and cushion the displacing force of the king post 26 upper end. Rather than supporting the king post, pipe 37 will merely yield without resisting in response to a force applied thereto. At such time, the placing of stabilizer 46 on the cell 33 will in effect substantially immobilize the latter thereby minimizing its function. It will, however, prevent further damage to either the cell or to king post 26.

To further position stabilizer 46, the latter is furnished with a plurality of longitudinal fastening rods 52 which depend from skirt 51 in a direction to extend concurrently with the cylindrical wall of casing 34. Thus, the stabilizer 46 is held in place not only by the collar 47, but also by the positioning of the respective rods 52 which extend from the skirt to surround said casing.

To achieve neutralization of shock cell 33 and more precisely to avoid deleterious movement of the center pipe 37 with respect to casing 34, the latter are brought into fixed contact by fastening stabilizer 46 to both the pipe and to the casing.

The structural integrity of stabilizer 46 is assured by provision of a plurality of spaced intermediate braces 53 which extend between collar 47 and skirt 51. Said braces 53 are spaced laterally about the collar to maintain the desired firm relationship between the skirt, and the collar at an approximate 90 degree angle.

When positioning the collar 47 onto the shock cell pipe 37, the split collar is initially held open by virtue of hinge 48 lowered onto pipe 37. After being connected and tightened in place by bolts 56, collar 46 can be provided with a plurality of longitudinally extending slots 54 which facilitate welding thereof to pipe 37 whereby of the collar to pipe 37 to assure rigidity therebetween. The connection can be further assured by welding the respective longitudinal rods 52 extend to casing 34, thus holding the entire unit 46 in place to avoid as noted, the movement of the resilient connector under loaded conditions.

It is understood that although modifications and variations of the invention may be made without departing from the spirit and scope thereof, only such limitations should be imposed as are indicated in the appended claims.

We claim:

1. In a shock absorbing marine bumper for a structure positioned in a body of water, said structure including; a support member (13) which extends beneath the water's surface, a foundation member (21) depending outwardly from said support member, an elongated king post (26) having opposed upper and lower ends, and disposed substantially uprightly in the body of water to contact a vessel floating adjacent to the structure, said king post lower end being supportably engaged with said foundation member (21), a resiliently compressible shock absorber (33) including a casing (34) which depends outwardly from said support member (13), having a retractably mounted pipe (37) which protrudes axially from the casing to engage the king post upper end, whereby displacement of said king post by a floating vessel will cause said pipe (37) to retract into said shock absorber casing (34) while resisting said king post movement, the improvement therein for provisionally obviating the shock absorbing action of said shock absorber (33) which comprises a stabilizer including a collar (47) which is removably fixed to the portion of said pipe (37) which protrudes axially from said casing (34), and at least one contact member (51) which extends outwardly from said collar (47) to engage said casing (34) thereby precluding further axial movement of said pipe (37) relative to said casing (34).

2. In the apparatus as defined in claim 1, wherein said stabilizer's at least one contact member includes at least two arms depending outwardly from said collar to engage said casing.

3. In the apparatus as defined in claim 1, wherein said stabilizer's at least one contact member includes a skirt depending outwardly from said collar to engage said casing.

4. In the apparatus as defined in claim 1, wherein said stabilizer collar comprises a pair of cooperative segments, each thereof defining a partial collar, and a partial skirt depending from said collar, which skirt extends outwardly to engage said casing.

5. In the apparatus as defined in claim 1, including lateral support means (53) fixed to and extending between said collar and said at least one contact member.

6. In the apparatus as defined in claim 1, wherein said at least one contact member overlaps the edge of said casing, and a plurality of positioning rods (52) depend from said at least one contact member to engage the casing periphery.

* * * * *